US008123665B2

(12) United States Patent
De Matteis

(10) Patent No.: US 8,123,665 B2
(45) Date of Patent: Feb. 28, 2012

(54) MULTI-FOLD INTERFOLDING MACHINE STRUCTURE

(75) Inventor: Alessandro De Matteis, Lucca (IT)

(73) Assignee: MTC-Macchine Trasformazione Carta S.R.L., Porcari, Lucca (IT)

( * ) Notice: Subject to any disclaimer, the term of this patent is extended or adjusted under 35 U.S.C. 154(b) by 112 days.

(21) Appl. No.: 12/412,441

(22) Filed: Mar. 27, 2009

(65) Prior Publication Data

US 2009/0289407 A1 Nov. 26, 2009

(30) Foreign Application Priority Data

May 23, 2008 (EP) ..... 08156875

(51) Int. Cl.
*B31F 1/00* (2006.01)

(52) U.S. Cl. ... 493/360; 270/5.02; 270/5.03; 270/39.01; 270/39.05; 270/39.06; 270/39.09; 270/58.07; 493/411; 493/413; 493/430; 493/433

(58) Field of Classification Search ..... 270/6–9, 270/5.02, 5.03, 20.1, 21.1, 30.01, 30.05, 270/30.06, 30.08, 30.09, 30.11, 30.12, 32, 270/39.01, 39.05, 39.06, 39.09, 43, 58.07; 493/360, 411, 413, 430, 432, 433, 446
See application file for complete search history.

(56) References Cited

U.S. PATENT DOCUMENTS

| | | | | |
|---|---|---|---|---|
| 4,725,469 | A | 2/1988 | Summerfield | |
| 7,121,994 | B2 * | 10/2006 | Haasl | 493/442 |
| 7,329,221 | B2 * | 2/2008 | Haasl et al. | 493/428 |
| 7,407,161 | B2 * | 8/2008 | White | 271/270 |
| 7,442,157 | B2 * | 10/2008 | De Matteis | 493/411 |
| 7,452,321 | B2 * | 11/2008 | Kauppila | 493/418 |
| 7,530,569 | B2 * | 5/2009 | White | 271/276 |
| 2006/0052228 | A1 | 3/2006 | De Matteis | |
| 2007/0082800 | A1 * | 4/2007 | Kauppila | 493/427 |
| 2007/0203007 | A1 * | 8/2007 | De Matteis | 493/360 |
| 2009/0253564 | A1 * | 10/2009 | Butterworth | 493/357 |

FOREIGN PATENT DOCUMENTS

| | | |
|---|---|---|
| EP | 1514677 | 3/2005 |

* cited by examiner

*Primary Examiner* — Leslie A Nicholson, III
(74) *Attorney, Agent, or Firm* — Dennison, Schultz & MacDonald

(57) ABSTRACT

Interfolding machine of sheet material for making a stack of interfolded sheets (1) equipped with cutting and transferring means, including, for example, a cutting roller 2 that operates the division of the web (10) into sheets (11) of determined length. The cut sheets (11), all having the same length, are carried along the machine up to a transfer roller (3) that transfers them to an "overlap" roller (4). In particular the cutting roller (2) has peripherally a first series of cutting blades (21*a*)-(21*d*) arranged at a first angular distance equal to 90° and a second plurality of cutting blades (21'*a*)-(21'*c*) arranged at a second angular distance equal to 120°. The length of sheets 11 is therefore achieved by the angular distance existing between the blades (21). In order to adjust the length of the sheets, or cut-off length, one selects the blades on the cutting roller (2) located at an angular distance corresponding to the desired sheet length.

20 Claims, 10 Drawing Sheets

Fig. 4A
Fig. 4B
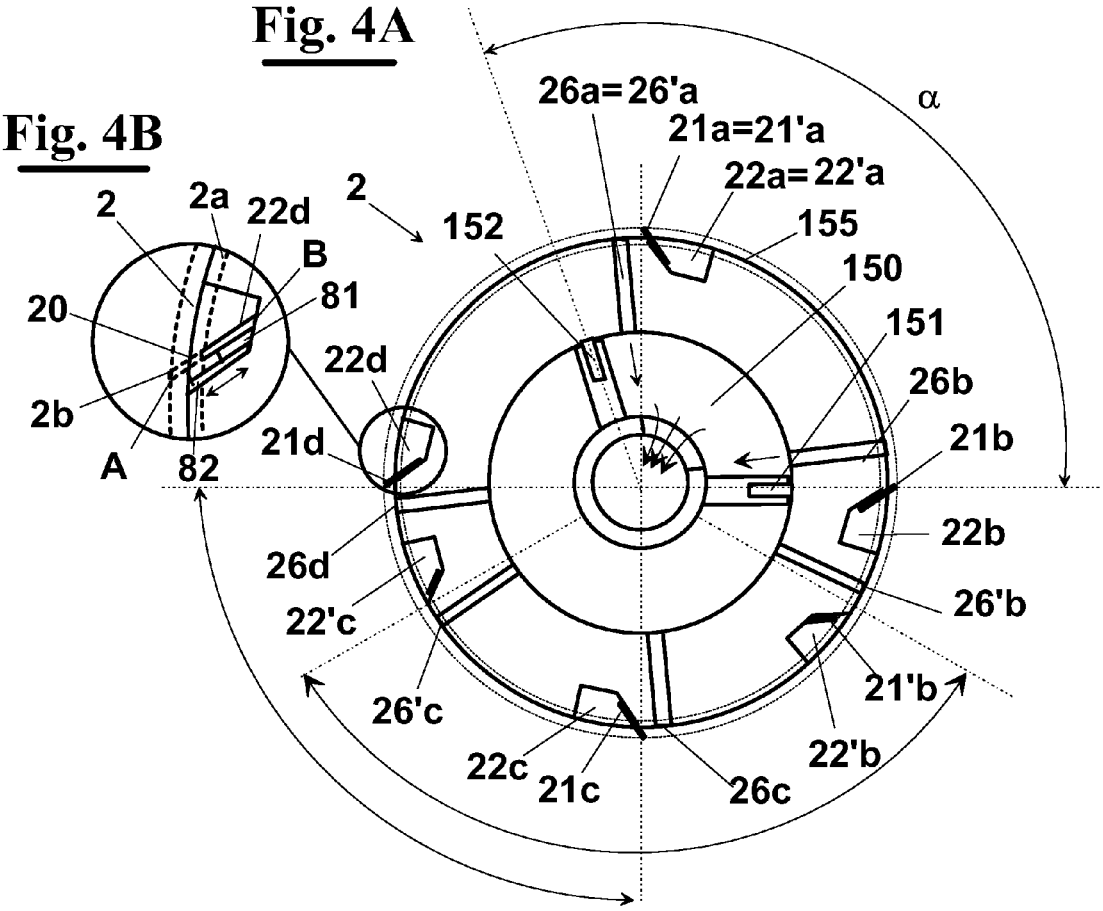
Fig. 4C
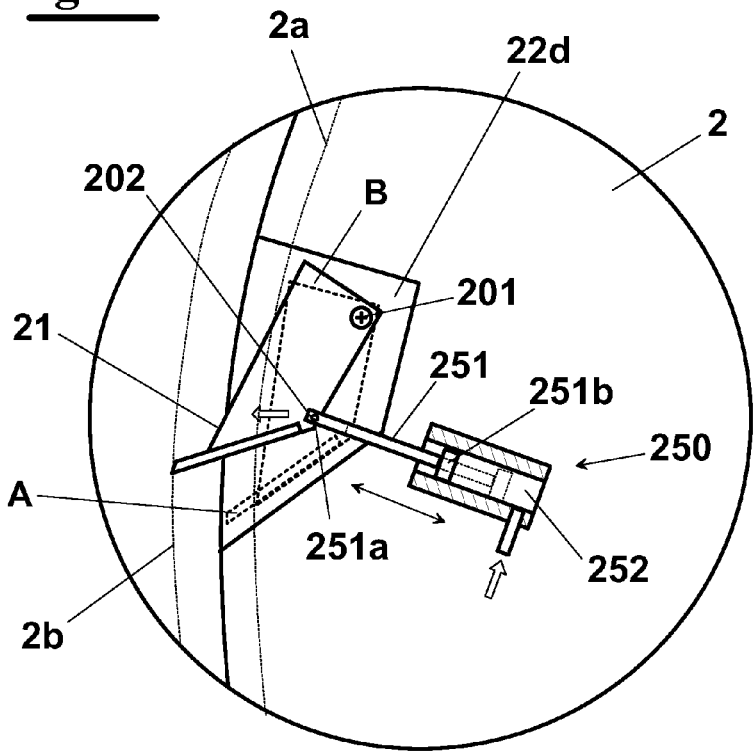

MULTI-FOLD INTERFOLDING MACHINE STRUCTURE

FIELD OF THE INVENTION

The present invention relates to the production of paper material in stacks of interfolded sheets, and, in particular, it relates to a structure of interfolding machine adapted to process sheets of different length.

BACKGROUND OF THE INVENTION

As well known, in the paper converting industry a variety of types is used of machines and of processes for making paper tissues, paper towels and similar articles in stacks of a certain height of interfolded sheets.

They are obtained stacking the sheets in an "interfolded" way, i.e. at each fold a wing of the previous sheet and a wing of a next stack sheet engage with each other. This way, when drawing a sheet from a package, at the moment of the use, also a wing of a next stack sheet is dragged up to protruding from the package, with subsequent practical employment for certain types of users. Among possible interfolding ways the L-type, with 2 panels (single fold), or the Z or W types, respectively with 3 and 4 panels (multi fold), are known.

The interfolding machines use one or more webs of paper, which from one or more large rollers and which are cut into sheets and then supplied offset with respect to one another on folding counter-rotating rollers.

More precisely, the webs are cut into sheets by means of cutting rollers that interact alternatively, with relative counter-support blades. In case of L-type interfolding (single-fold) the webs are cut to form a shifted succession of sheets coming preferably from two different directions. Then, the sheets coming from either directions are fed in an alternated way to the folding rollers, so that each sheet coming from the first direction is overlapped with a portion of the sheet coming from the second direction, and vice-versa.

The sheets coming from the two directions, in order to be overlapped in the way above described, adhere to the respective folding rollers by a holding system comprising either suction holes or mechanical clamps. Then, the downstream portion of each sheet leaves a respective folding roller at the contact line between the two rollers, held by the other folding roller, which is holding already the upstream portion of the previous sheet.

In case of Z or W type interfolding, or even in case of much more folds, as disclosed in U.S. Pat. No. 3,490,762, so-called "multifold", the interfolding method can be similar to what described above, with the difference that The overlapping step between two successive sheets is carried out immediately after the cut and a stream of partially overlapped sheets reaches the folding rollers from a single direction.

In particular, the folding rollers have a circumference as a multiple to the length of the not overlapped portion of two overlapped sheets. Therefore, the stack of sheets adds an interfolded sheet after each fraction of turn of the folding rollers. This parameter determines the size of the folded sheet being stacked, i.e. the width of the interfolded sheets packages. In view of that, one of the parameters of reference for an interfolding machine is the stack width.

Another reference parameter for an interfolding machine is the length of the sheets, also called cut-off. In particular, in the interfolding machines the length of the interfolded sheets that eventually form the stack of final product is responsive to the circumference of the cutting rollers and to the angular distance among the cutting blades. In other words, the cutting length is fixed and is determined univocally by the circumference of the cutting roller or rollers.

By changing the length of the sheets, or cut-off, it is possible to keep the same pack width, by adjusting the number of interfolded panels.

It can be in particular preferable to adjust the cut-off without changing the pack width, leaving the user a variety of choices for making packs.

A common interfolding machine of "multifold" type allows to produce interfolded sheets of a single length, with an extremely stiff process, and for each sheet length a different machine is required.

In EP 1826165, in the name of the same applicant, an interfolding machine is described multi-fold of modular type, in which it is possible to cut a web of paper into sheets of different length after replacing a modular portion comprising the cutting roller and the transfer roller with another modular portion comprising a cutting roller and a transferring roller of different diameter, and then capable of cutting the web into sheets of different length and causing the sheets to be transferred to an overlapping section.

This solution overcomes the limits of the multi-fold interfolding machines of traditional type, i.e. that of cutting a web of paper into sheets and processing the sheets of a single length.

However, such machines require an area for arranging different modules and involve costs of each modular additional portion and, even if require a relatively quick production change time, they need in any case a maintenance stop.

SUMMARY OF THE INVENTION

It is therefore a feature of the present invention to provide a structure of interfolding machine that produces stacks of interfolded sheets allowing a change of production with sheets of different length in order to change easily and quickly between different interfolded configurations.

It is another feature of the present invention to provide an interfolding machine adapted to process sheets of different length that is structurally much easier and cheap with respect to similar interfolding machines of the prior art.

These and other objects are accomplished by the interfolding machine of a web of paper, or similar products, according to the present invention, comprising:

- feeding means adapted to feed at least one web of paper;
- cutting and transferring means of said web of paper adapted to cut said web of paper into sheets of determined length and to transfer them along a conveying path;
- actuating means of said cutting and transferring means so that said web of paper and said sheets proceed at a first speed V1;
- overlapping means adapted to pick up said sheets from said conveying path and to overlap them in turn by a predetermined sheet portion;
- actuating means of said overlapping means adapted to convey said sheets at a second speed V2 less than V1, said speed difference being imposed for overlapping partially two consecutive sheets according to said sheet portion;
- folding means of the consecutive overlapped sheets into panels in order to provide a stack of interfolded sheets;

whose main feature is that said cutting and transferring means comprises a first cutting, transferring and overlapping means for sheets of a first length and at least a second cutting, transferring and overlapping means for sheets of a second length.

Advantageously, means are provided for selecting alternatively, one among said first cutting, transferring and overlapping means for sheets of a first length and said second cutting, transferring and overlapping means for sheets of a second length.

In particular, said cutting and transferring means cut the web of paper in combination with counter support means acting opposite to said web of paper with respect to said cutting and transferring means to provide said division into said sheets of said first or said second length.

Advantageously, said cutting and transferring means comprises at least one cutting and transferring roller, and said first cutting, transferring and overlapping means for said sheets of a first length comprises a first plurality of blades arranged peripherally on said cutting and transferring roller at a first angular distance and said second cutting, transferring and overlapping means for said sheets of a second length provides a second plurality of blades arranged peripherally on said cutting and transferring roller at a second angular distance, said first and said second plurality of blades being selectively operated for cutting said web into sheets of said first and of said second length, respectively.

Advantageously, said cutting and transferring means comprises, at each of said blades, gripping means of each sheet at least at a respective sheet head that has been formed after cutting.

Advantageously, said cutting and transferring means comprises, furthermore, gripping means of each sheet at least at a portion comprising a respective sheet tail formed after cutting, such that a successive sheet that moves along said conveying path overlaps by said measured portion under a previous sheet whose head has been already gripped by said overlapping means.

Alternatively, said cutting and transferring means comprises:

- a cutting roller having a first plurality of blades arranged peripherally on said cutting roller at a first angular distance and a second plurality of blades arranged peripherally on said cutting roller at a second angular distance, said first and said second plurality of blades being selectively operated for cutting said web into sheets of said first and of said second length, respectively;
- wherein said cutting roller comprises, at each of said blades, gripping means for the cut adapted to keep each sheet at least at a respective sheet head that has been formed after cutting.

Advantageously, the cutting and transferring means comprises:

- a transfer roller having a first plurality of sheet head gripping means arranged peripherally at a first angular distance and that is adapted to transfer to said sheet overlapping roller said sheets of said first length, and a second plurality of sheet head gripping means arranged peripherally at a second angular distance and that is adapted to transfer to said sheet overlapping roller said sheets of said second length, said transfer roller comprising, furthermore, means for gripping and overlapping each sheet at least at a respective sheet tail such that a successive sheet that moves along said conveying path overlaps by said measured portion under a previous sheet whose head has been already gripped by said sheet overlapping roller and whose tail has been held by said means for gripping and overlapping.

Advantageously, the cutting and transferring means comprises a transfer roller having a plurality of sheet head gripping means arranged peripherally at an angular distance that defines an arch equal to the length of a sheet and that is adapted to transfer to said sheet overlapping roller said sheets of said first and second length, said transfer roller comprising, furthermore, means for gripping and overlapping each sheet at least at a respective sheet tail such that a successive sheet that moves along said conveying path overlaps by said measured portion under a previous sheet whose head has been already gripped by said sheet overlapping roller and whose tail has been held by said means for gripping and overlapping.

In particular, said means for gripping and overlapping the sheets at the respective sheet tail acts only in a determined arch of the transfer roller.

Advantageously, means are provided for adjusting the amplitude of said arch of the transfer roller at which said tail of said sheets is gripped.

In particular, said first plurality of blades and said second plurality of blades can be mounted at respective housings in a way movable selectively between a cutting position, in which said blades protrude from said cutting roller, and a rest position, in which said blades are withdrawn with respect to said cutting roller.

Advantageously, means are provided for actuating said blades between said cutting position and said rest position.

In particular, the means for actuating each blade comprises:

- an actuator, for example a pneumatic actuator, having a stem with an end connected to the blade and the other end that is movable in an actuating chamber, said blade being pivotally constrained to said roller at a pivot point, said end of said actuator sliding in said actuating chamber for causing the rotation of said blade about said pivot point to obtain a movement of said blade from said cutting position to said rest position, or vice-versa.

Alternatively, the means for actuating the blades comprises a carriage integral to each blade sliding on a guide, said carriage withdrawing/protruding with respect to the boundary of said roller along said guide for bringing said blade from said cutting position to said rest position, or vice-versa.

Alternatively, said cutting roller has a first plurality of blade holders arranged peripherally on said roller at said first angular distance and a second plurality of blade holders arranged peripherally on said roller at said second angular distance, such that said blades can be mounted on said roller at said first or at said second plurality of blade holders to provide said sheets of said first, or of said second length, respectively.

Furthermore, means are provided for adjusting said actuating means of said cutting and transferring means, said means for adjusting being adapted to change at least one parameter selected from the group comprised of:

- speed V1;
- speed V2;
- the ratio between speed V1 and V2;
- a phase shift between the cutting and transferring means and said overlapping means;
- a combination thereof.

Advantageously, said first and second plurality of blades have a blade in common.

In particular, the sheet head gripping means are adapted to keep a sheet stuck to the transfer roller for a determined arch.

Advantageously, furthermore, folding means are provided comprising folding rollers, said folding means being adapted to arrange said partially overlapped sheets in a determined interfolded configuration in order to form underneath a stack of interfolded products.

Furthermore, separating means are provided adapted to separate a stack of interfolded sheets from a next stack and to carry it away from the separating area by separating means.

In particular, the cutting means and the sheet head gripping means can be arranged in rows on the respective rollers.

Normally, in an interfolding machine, where the sheets are folded by the folding means according to panels of a same length, so that each sheet has a length that is multiple to the number of panels, being L1 said first length and N1 the number of panels of the sheets of said first length, and being L2 said second length and N2 the number of panels of the sheets of said second length, and being L the length of the panels, so that L1=L*N1, and L2=L*N2, the circumference of the cutting roller and of the transfer roller is identical or multiple to the minimum common multiple between N1 and N2 multiplied by the respective length of the panels, and the first and second cutting, transferring and overlapping means are arranged along the circumference in positions multiple both to N1 and to N2.

An interfolding machine that is made as above described is highly flexible and can provide on a single machine three-panel interfolded sheets, or Z-fold, four-panel interfolded sheets, or W-fold, and six-panel interfolded sheets, wherein the sheet head gripping means and the cutting means provide:

- a first unit comprising four sheet head gripping means or cutting means arranged at an angular distance of 90°,
- a second unit comprising three sheet head gripping means and cutting means arranged at an angular distance of 120°.

In fact, being twelve the minimum common multiple between three, four and six, by using a roller with a circumference that is multiple to the length of twelve panels, it is possible to arrange the sheet head gripping means and the cutting means at 3, 4, 6, 8, 9, 12 panels, obtaining the above described angular distances.

Alternatively, in order to provide on a single machine three-panel interfolded sheets and five panel interfolded sheets, the sheet head gripping means provides:

- a first unit comprising five sheet head gripping means arranged at an angular distance of 72°,
- a second unit comprising three sheet head gripping means arranged at an angular distance of 120°.

In fact, being fifteen the minimum common multiple between three and five, by using a roller with a circumference that is multiple to the length of fifteen panels, it is possible to arrange the sheet head gripping means and the cutting means at 3, 5, 6, 9, 10, 12, 15 panels, obtaining such angular distance.

Advantageously, the sheet head gripping means can be selected from the group comprised of:

- a plurality of clamps;
- a plurality of suction holes connected to a vacuum distribution system.

In particular, the transfer roller in addition to the sheet head gripping means and to the sheet tail gripping means has further sheet gripping means at an intermediate sheet point to assist the movement of the sheet on the roller same.

Advantageously, the means for partially overlapping the sheets comprises a sheet overlapping roller adapted to cooperate with the transfer roller. In particular the transfer roller rotates at the first speed whereas the sheet overlapping roller rotates at the second speed in order to deposit on the sheet overlapping roller the overlapped sheets according to a measured fraction.

The holes of the sheet overlapping roller are adapted to grip the head of each sheet. The distance in a circumferential direction between the holes can be equal to two or to one sheet. In particular for a machine that provides one or two panel interfolded sheets, on the sheet overlapping roller four rows of holes rotationally spaced by 90° can be provided, with a distance between the two rows of consecutive holes equal to two panels, whereas for a machine that provides one or two or three-panel interfolded sheets, on the sheet overlapping roller six rows of holes rotationally spaced by 60° can be provided, with a distance between two rows of consecutive holes equal to two panels, and at the same time four rows of holes rotationally spaced by 90°, with a distance between two rows of consecutive holes equal to three panels.

In particular, means can be provided for activating the suction holes of the sheet overlapping roller. For example, two rows of suction holes at 180° can be provided in case of three-panel sheets interfolded by two panels.

Advantageously, each row of suction holes of said transfer roller is in pneumatic connection with a longitudinal duct put in pneumatic connection with a vacuum system and that become active suction holes only at a determined angular field of the transfer roller.

Furthermore, conveying means can be provided adapted to convey the partially overlapped sheets in a position set between the partial overlapping means and the folding rollers.

BRIEF DESCRIPTION OF THE DRAWINGS

Further characteristic and the advantages of the interfolding machine, according to the invention, will be made clearer with the following description of an exemplary embodiment thereof, exemplifying but not limitative, with reference to the attached drawings, in which like reference characters designed the same or similar parts, throughout the figures of which:

FIG. 4A shows in detail a cross sectional view of the arrangement of the cutting blades, according to the invention;

FIG. 4B shows an enlarged view of a blade of the cutting roller of FIG. 4A for highlighting the mechanism for bringing the blades from a cutting position to a rest position, or vice-versa;

FIG. 4C shows in detail a mechanism alternative to that shown in FIG. 4B for bringing the blades from a cutting position to a rest position, or vice-versa;

Figure 2A:
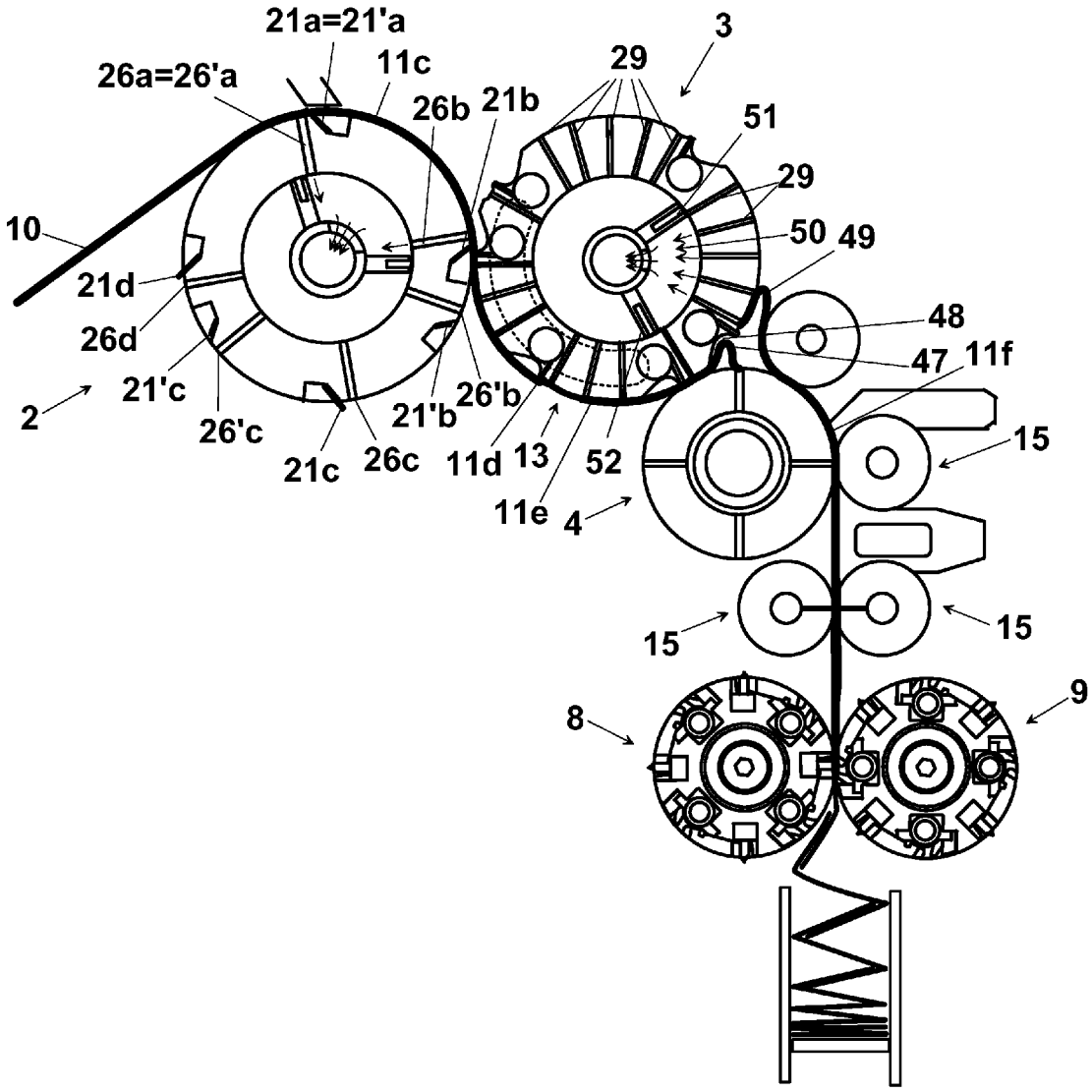
FIG. 2A shows diagrammatically a cross sectional view of some elements of FIG. 1 for highlighting particular technical aspects.
Figure 2B:
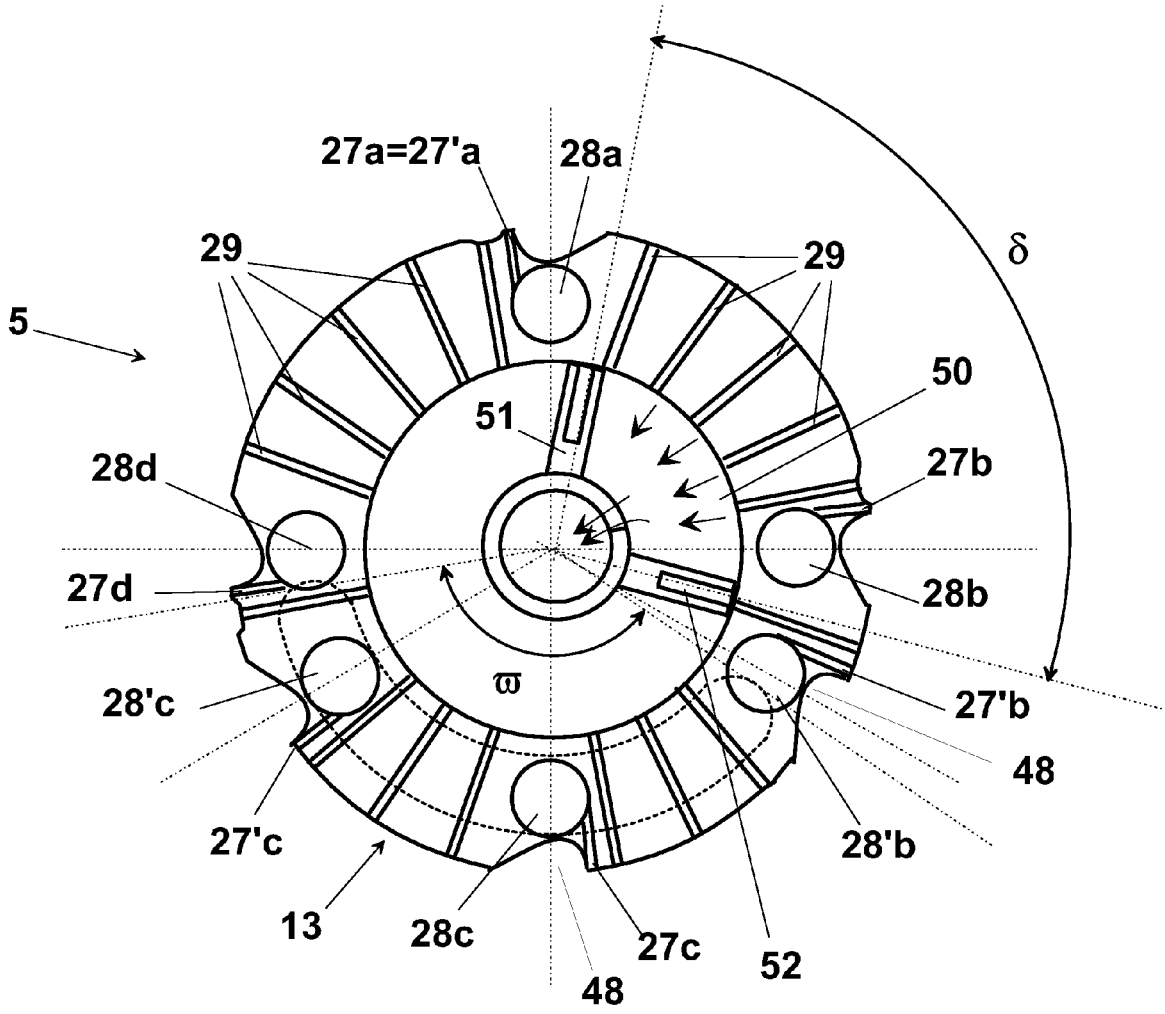
FIG. 2B shows in detail a cross sectional view of a transfer roller, according to the invention.
Figure 12:
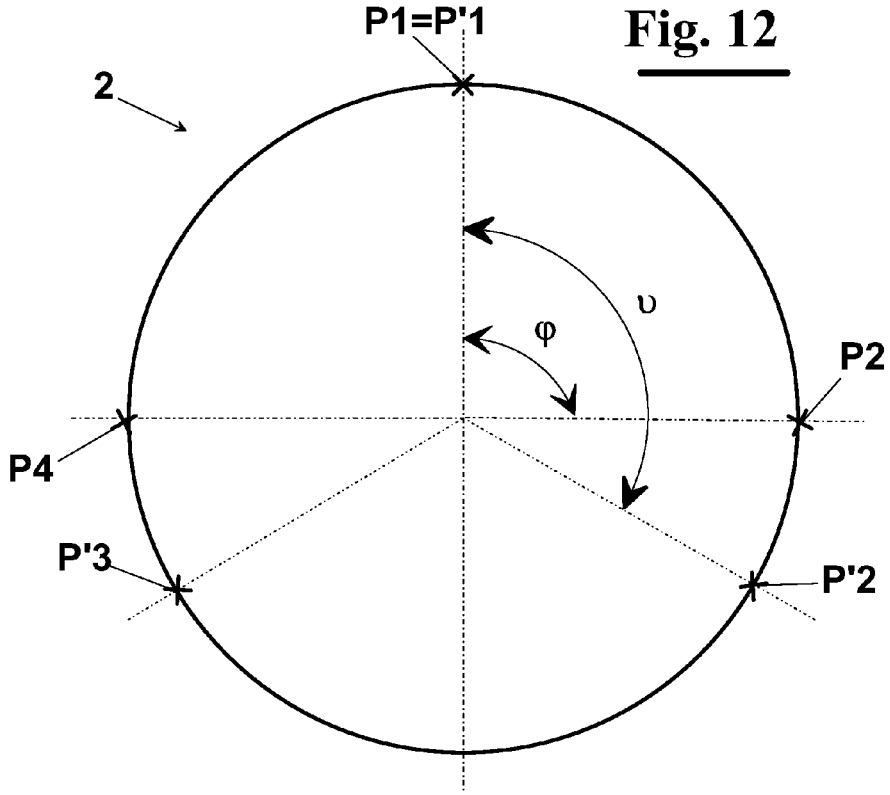
Figure 13:
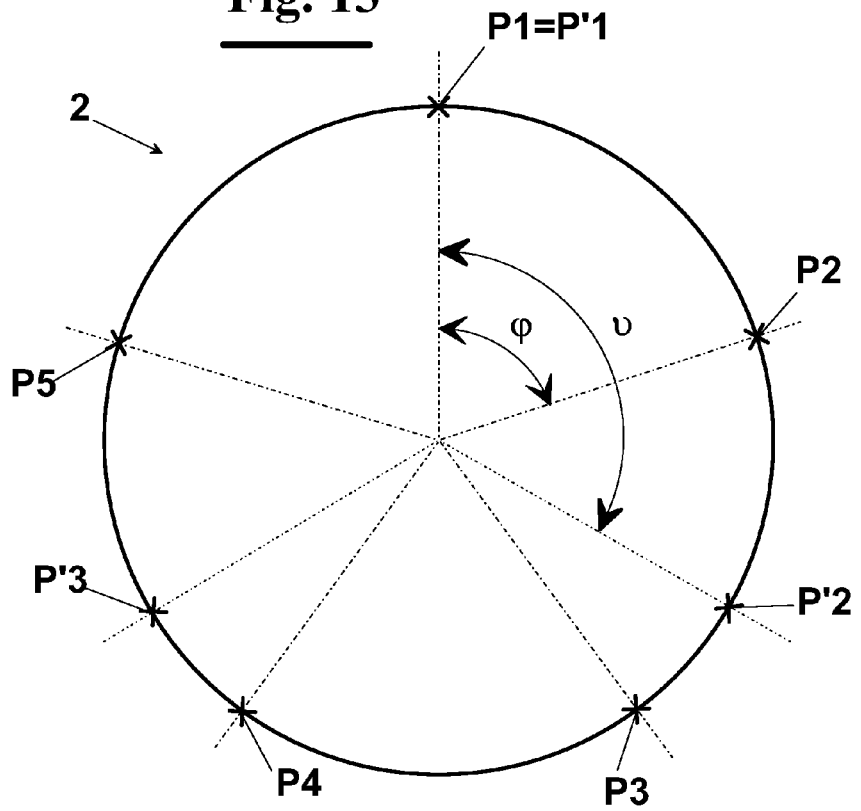
Figure 14:
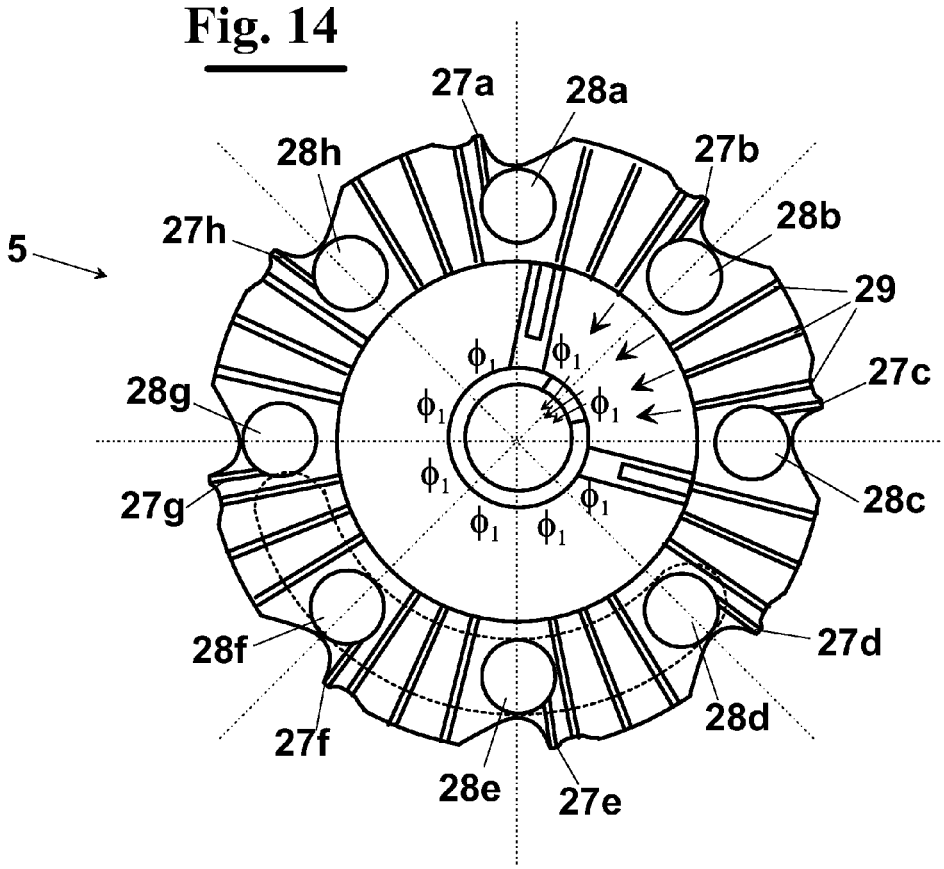
Figure 15:
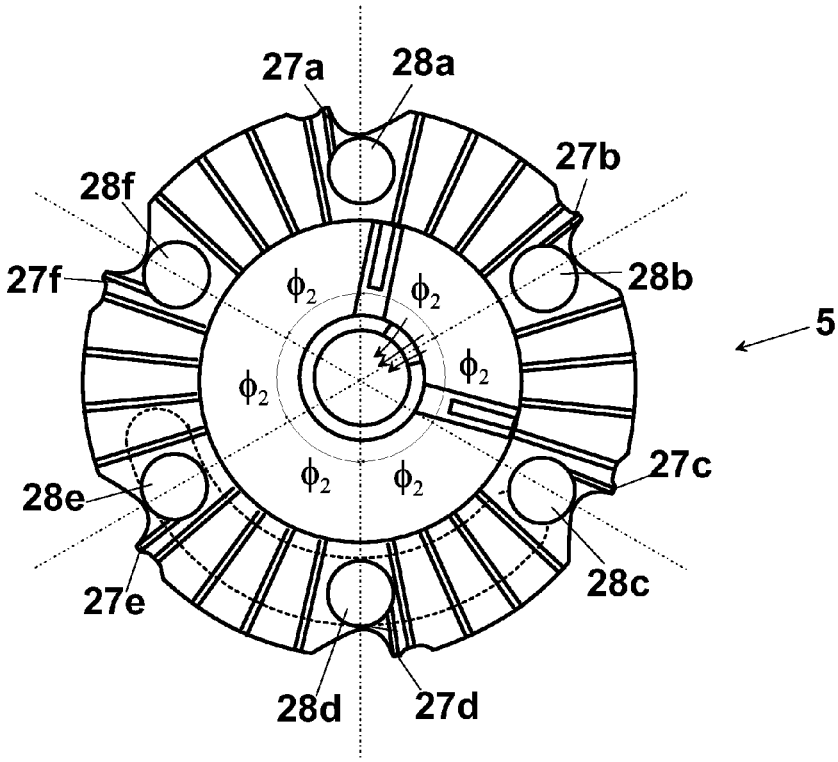

FIGS. from 5 to 7 show a cross sectional view of some cutting configurations obtainable by the cutting roller of FIG. 4A;

FIGS. from 8A to 11B show diagrammatically some overlapping configurations obtainable by the sheet overlapping roller according to the invention;

FIG. 12 shows diagrammatically generic positions of the cutting means and/or the gripping means of a cutting roller and/or of a transfer roller capable of providing various interfolded configurations;

FIG. 13 shows diagrammatically generic positions of the cutting means and/or the gripping means of a cutting roller and/or of a transfer roller capable of providing different interfolded configurations with respect to those obtainable by the cutting and/or conveying roller of FIG. 12;

FIGS. 14 and 15 show diagrammatically two possible exemplary embodiments of the transfer roller shown in FIG. 2B.

DESCRIPTION OF A PREFERRED EXEMPLARY EMBODIMENT

Figure 1:
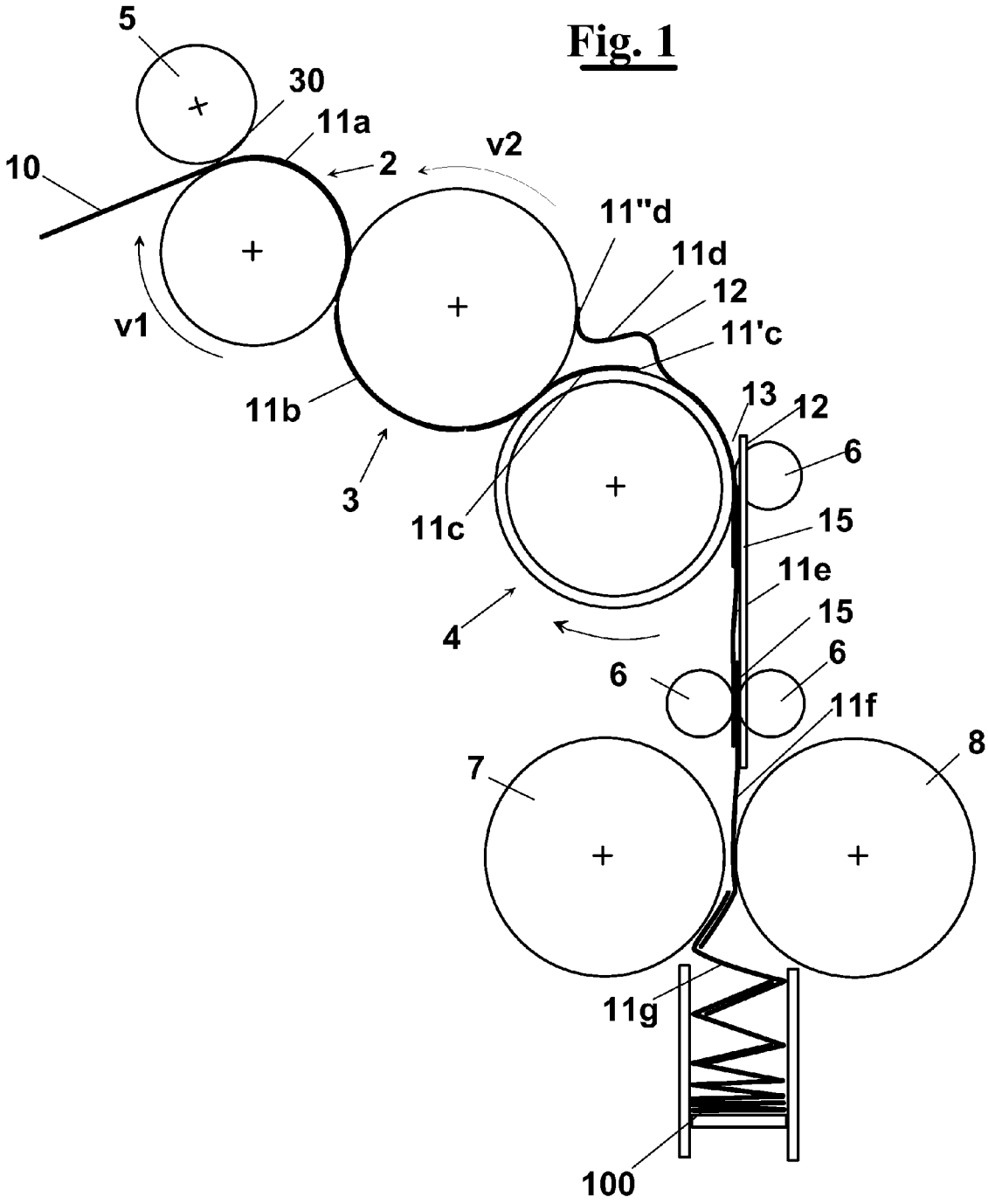
FIG. 1 shows diagrammatically an elevational side view of some elements of an interfolding machine, according to the invention.

With reference to FIG. 1, an interfolding machine of sheet material for making a stack of interfolded sheets 1 provides moving a web 10 of a material to interfold, for example paper, non woven fabric, or similar material, unwound from a feeding section, not shown in the figure.

In particular, the web of paper 10 is fed to the cutting and transferring means, comprising, for example, a cutting roller 2 that operates the division of the web 10 into sheets 11 of determined length. The cut sheets, having all the same length, which are carried along the machine are indicated as 11*a*, 11*b*, 11*c*, 11*d*, 11*e*, 11*f* and 11*g*, starting from the cutting point arranged at the cutting slit 30 of a cutting slit roller 5 fixed, up to the point where they are interfolded.

To this end a transfer roller 3 is provided that conveys sheets 11 to overlapping means, for example to a sheet overlapping roller, also-called "overlap" roller 4.

Up to transfer roller 3, sheets 11 travel along a conveying path at a speed V1, whereas starting from the overlap roller 4, sheets 11 are brought to a second speed V2, with V2 less than V1.

As above described, at first, the cut sheets 11*a*-11*g* proceed on transfer roller 3 that rotates at a first speed V1. Then, sheets 11*a*-11*g* pass on the sheet overlapping roller 4, or "overlap" roller, which rotates at a second speed V2 less than V1. This speed difference causes sheets 11*c* and 11*d* to overlap, since sheet 11*c* having speed V1 is put below the downstream sheet 11*d* having speed V2 less than V1, which is raised at its tail by the suction of holes 29. The overlapping portion, indicated as 15, of the two sheets 11*c* and 11*d* extends for a predetermined number of panels, in order to allow, downstream along the conveying path, the sheets to be interfolded for a desired number of panels, at folding rollers 6 and 7, adapted to make a stack 1.

Between the "overlap" roller 4 and the folding rollers 6 and 7 a conveying systems conveys sheets 11*d*-11*f*, partially overlapped, in a corresponding conveying path. In this path, so-called interfolding path, the sheets travel always at the second speed V2 less than V1.

With reference to FIG. 2, according to the invention, cutting roller 2 is peripherally comprised of a first series of cutting blades 21*a*-21*d* arranged at a first angular distance equal to 90° and of a second plurality of cutting blades 21'*a*-21'*c* arranged at a second angular distance equal to 120°. The length of sheets 11 is therefore caused by the angular distance existing between the active blades 21. In order to adjust the length of the sheets, or cut-off length, it is enough to select the blades that are present on cutting roller 2 located at an angular distance corresponding to the desired sheet length, as described hereinafter.

In the case shown in FIG. 2, the blade 21*a* of the first series of blades coincides with the blade 21'*a* of the second series of blades. This reduces the overall number of blades, assisting the work of cutting roller 2 and reducing, furthermore, the worked areas of cutting roller 2 same. However, it is possible to arrange blades 21*a*-21*d* and blades 21'*a*-21'*c* of the two groups such that they do not have blades in common. Each series of blades 21*a*-21*d*, or 21'*a*-21'*c*, causes the division of the web of paper 10 into sheets 11 of measured length.

Each blade 21 of cutting roller 2 is associated with gripping means of sheet 11 at the head 11' thereof. For example, the gripping means of sheet 11 at the head 11' can comprise a plurality of suction holes 26*a*-26*d* for blades 21*a*-21*d* and a plurality of suction holes 26'*a*-26'*c* for blades 21'*a*-21'*c*. The suction holes 26*a*-26*d* and 26'*a*-26'*c*, in particular grip the head 11' of sheet 11 which has been obtained with the cut and hold it stuck to roller 2 for an arch set between blade 21, which has caused the cut, which is tangent to transfer roller 3.

Cutting roller 2 works, in fact, in synchronism with transfer roller 3 which has a first and at least a second plurality of gripping means for conveying the head 11' of sheet 11. Also the gripping means for transferring the sheets can provide a first series of rows of suction holes 27*a*-27*d* and a second series of rows of suction holes 27'*a*-27'*c*.

In particular, the rows of the suction holes 27*a*-27*d* can be arranged on transfer roller 3 at an angular distance from each other equal to 90°, whereas the lines of the suction holes 27'*a*-27'*c* can be arranged on transfer roller 3 at an angular distance equal to 120°.

Also concerning the series 27*a*-27*d* and 27'*a*-27'*c* of suction holes of transfer roller 3, each suction hole 27 is capable of gripping the head 11' of sheet 11 and keeping it stuck the roller surface of transfer roller 3 only at the arch of circumference 13 which defines an angle ω (FIG. 4A).

In addition to the series of suction holes 27*a*-27*d* and 27'*a*-27'*c*, transfer roller 3 has holes 29 that are put in pneumatic connection with a vacuum system, and then in a suction condition, only at a determined angular field 50 having an angular amplitude measured δ of transfer roller 3 same (FIG. 2A).

In particular, the angular field 50 extends downstream of tangency point with overlap roller 4 and is adapted create suction only in holes 29 of transfer roller 3 arranged in the vicinity of it. This way, the tail 11"*d* of the downstream sheet 11*d* is gripped by suction only after that the head 11'*d* has been gripped by the overlap roller 4. This allows the upstream sheet 11*c* to slide under sheet 11*d*, by the speed difference between the rollers 3 and 4. Then, when the hole 29' that grips by suction the sheet tail has overtaken the angular field 50, it releases sheet 11*d* that falls partially on sheet 11*c* obtaining a partially overlapping of the two sheets.

The speed difference V1−V2 determines the length of the overlapping portion, which can be equal to one, two or three panels. This speed difference causes the production a bend 47, immediately starting from the zone that follows the sheet head 11*e*, and transfer roller 3 has recesses 48 for receiving this bend. The same bend 47 increases progressively and propagates towards the tail of the sheet, as shown for sheet 11*f*.

More precisely, concerning the operation of the overlapping system, overlap roller 4 rotates at a speed V2, i.e. slower than transfer roller 3. This causes sheet 11*d*, which is transferred by transfer roller 3 to overlap roller 4, owing to vacuum systems 29, 51, 52 shown in FIG. 2A, to form bend 47. In the meantime, the tail of downstream sheet 11*e*, which is still gripped by transfer roller 3, has passed a nip that exists between overlap roller 4 and transfer roller 3, creating a bend 49, so that the head of the upstream sheet 11*d* proceeds from transfer roller 3 to overlap roller 4 causing the two sheets to overlapping with each other for a desired number of panels.

The suction angular field 50 is defined by two fixed tight wings 51 and 52, arranged at an angle. Alternatively, the tight wings can be movable in order to adjust the amplitude of the suction angular field 50, where necessary.

Similarly, cutting roller 2 has a mechanism similar to that described for transfer roller 3 to cause the grip by suction of the sheets on the roller surface only on an arch 155. As shown in FIG. 4A, in particular roller 2 has radial tight wings 151 and 152 defining an angular field 150 at which the holes of roller 2 can grip a sheet by suction.

Figure 3:
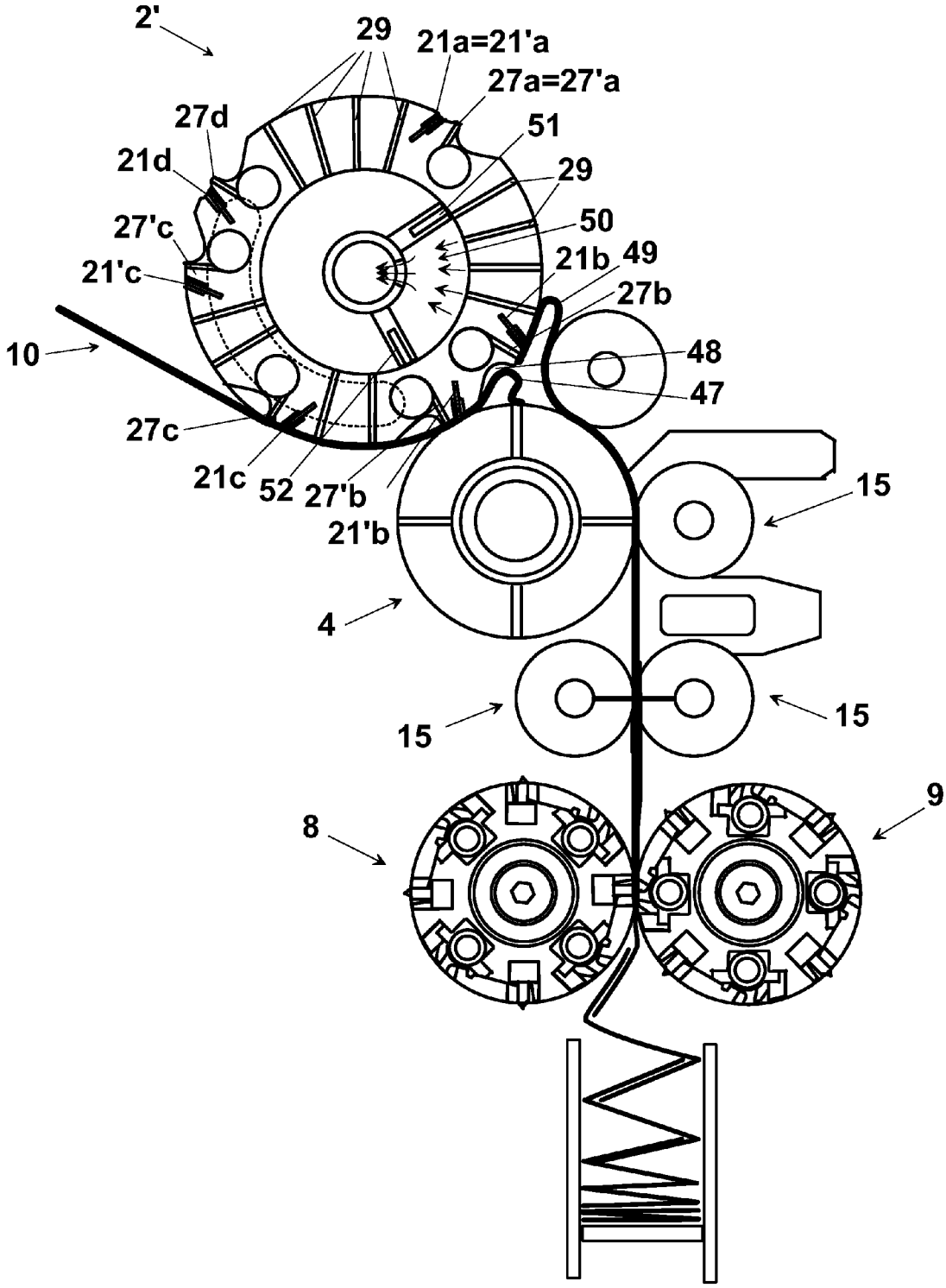
FIG. 3 shows diagrammatically a cross sectional view of some structural elements of an exemplary embodiment of the invention for the machine of FIG. 1, with cutting and transferring roller made as a single cutting and transferring roller.

In the exemplary embodiment shown in FIG. 3, the cutting and transferring means are made only on roller 2'. In particular roller 2' comprises a first plurality of blades 21*a*-21*d* arranged at 90° on its boundary and a second plurality of blades 21'*a*-21'*c* arranged at 120°. Roller 2', furthermore, has a first plurality of gripping means 27*a*-27*d* of a sheet head 11 and a second plurality of gripping means 27'*a*-27'*c*. Furthermore, roller 2' has tight wings 51 and 52 defining an angular field 50 at which holes 29 grips by suction sheets 11 on the roller surface 2. In this case, the web of paper 10 is cut into sheets 11 on roller 2' and from that is directly transferred to overlap roller 4. For all the other aspects roller 2' works in a way similar way to the combination of rollers 2 and 3 as described above, and it accomplishes similar functions.

As shown in detail in FIGS. 4A and 4B, the first series of blades 21*a*-21*d* and the second series of blades 21'*a*-21'*c* can be integral to respective carriages 81 that are slidingly mounted along guide 82 made at respective housings 22*a*-22*d* and 22'*a*-22'*c*. More in detail, each blade 21 is movable within the respective housing 22 between a cutting position A, which protrudes with respect to circumference 20 of cutting roller 2, and a rest position B, withdrawn with respect to circumference 20. Therefore, for cutting the web 10 into sheets of length L1 it is enough to cause the movement of blades 21*a*-21*d* to position A and the withdrawal of blades 21'*a*-21'*c* to withdrawn position B. Similarly, for cutting the web 10 into sheets of length 12 it is enough to cause the movement of blades 21'*a*-21'*c* to position A and the withdrawal of blades 21*a*-21*d* to withdrawn position B.

In an exemplary embodiment of the invention, shown in FIG. 4C, each blade of the first plurality 21*a*-21*d*, or of second plurality 21'*a*-21'*c*, is provided hinged to roller 2 in a respective point 201 at the respective housing 22*a*-22*d* and 22'*a*-22'*c*. Each blade of the first plurality 21*a*-21*d*, or the second plurality of blades 21'*a*-21'*c*, is, furthermore, connected to a second point 202 at one end 251*a* of a stem 251 of an actuator, for example a pneumatic actuator 250. The stem 251 has the other end 251*b* sliding in an actuating chamber 252. In particular the end 251*b* which is sliding in the actuating chamber 252 in a direction causes the rotation of said blade about a point 201 to obtain a movement of the same to cutting position B, whereas when end 251*b* slides in the opposite direction it causes the rotation of the blade in an opposite direction and moves to rest position A.

As shown in FIGS. from 5 to 7, it is possible, in particular, to cause first series of blades 21*a*-21*d*, and second series of blades 21'*a*-21'*c*, to protrude or to withdraw responsive to a desired length of sheet 11, i.e. of the desired type of interfolded configuration.

Figure 5:
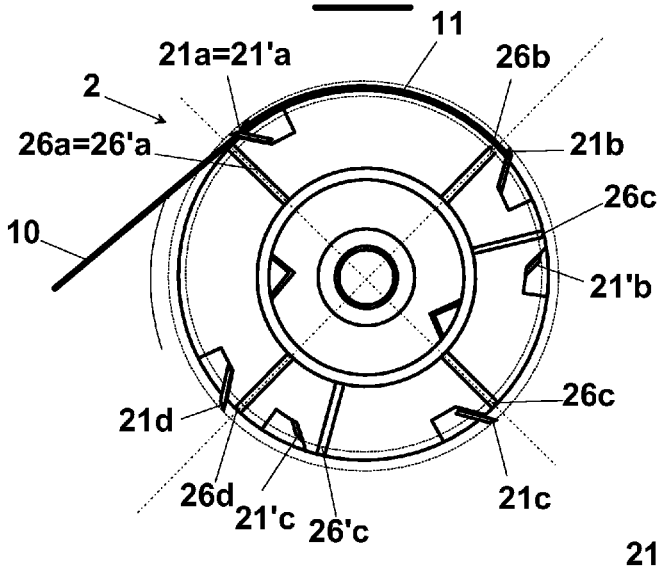

When blades 21*a*-21*d* of the first series are caused to protrude, for example, then web of paper 10 is cut into sheets 11 having the same length as a fourth of the circumference of cutting roller 2 (FIG. 5). In this case, each sheet 11 is then folded by interfolding rollers 7 and 8 into three panels I-III obtaining a "Z" interfolded configuration, with the last panel III of downstream sheet 11*a* that is overlapped to the first panel III of upstream sheet 11*b* (FIGS. 5A and 5B).

Figure 6:
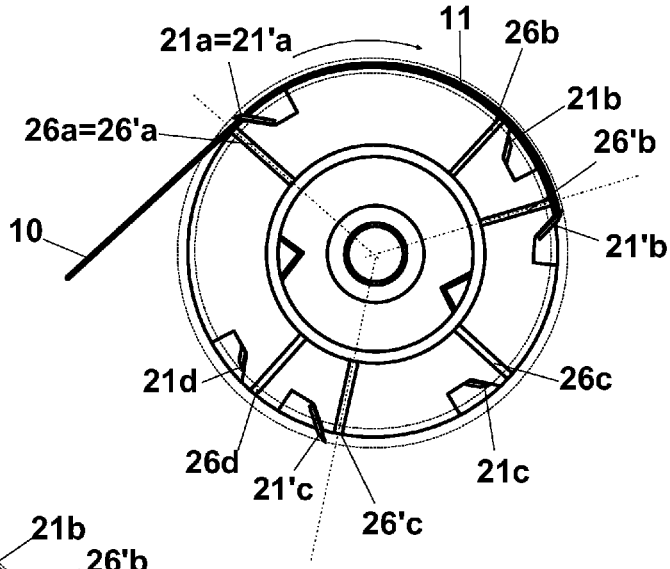

The second plurality of cutting blades 21'*a*-21'*c*, instead, cuts the web of paper 10 into sheets 11 having a length that is a third of the circumference of cutting roller 2 (FIG. 6). Therefore, sheets 11 obtained operating the first series of blades 21*a*-21*d* have a length L1 equal to ¾ of the length 12 of sheets 11 that are obtained operating the second series of blades 21'*a*-21'*c*.

Figure 9A:
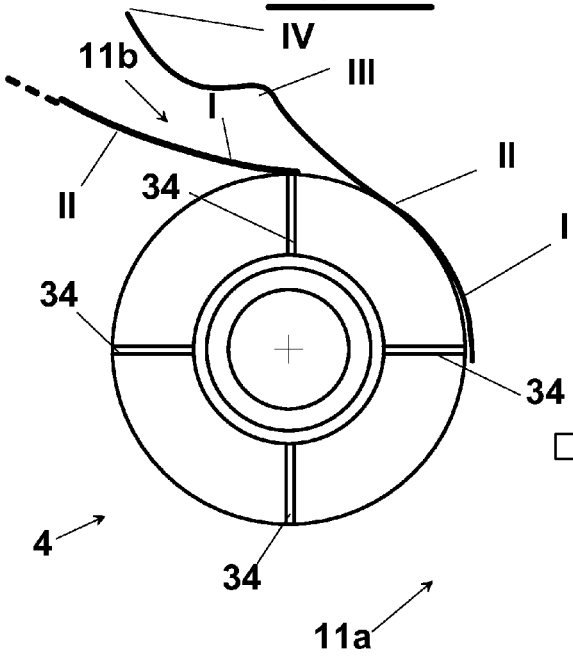
Figure 9B:
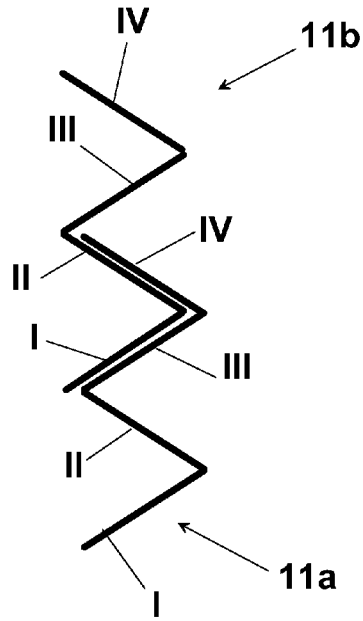

In this case, each sheet 11 is then folded by the interfolding rollers 7 and 8 into four panels I-IV, obtaining a "W" interfolded configuration, with the last two panels III and IV of downstream sheet 11*a* that is overlapped to panels III and IV of upstream sheet 11*b* (FIGS. 9A and 9B).

Figure 7:
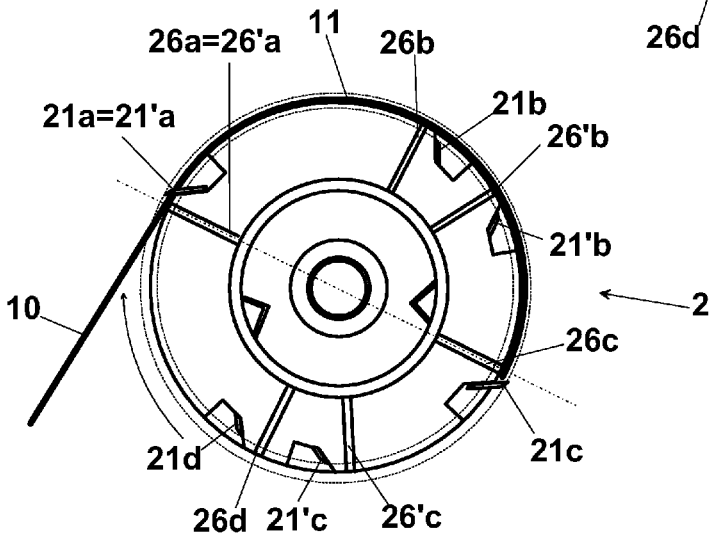

A further possibility provided by the present invention is to move to an advanced position only two blades, for example blade 21*a* and blade 21*c* of the first series of blades 21*a*-21*d*, i.e. arranged at an angular distance of 180° (FIG. 7).

Figure 10A:
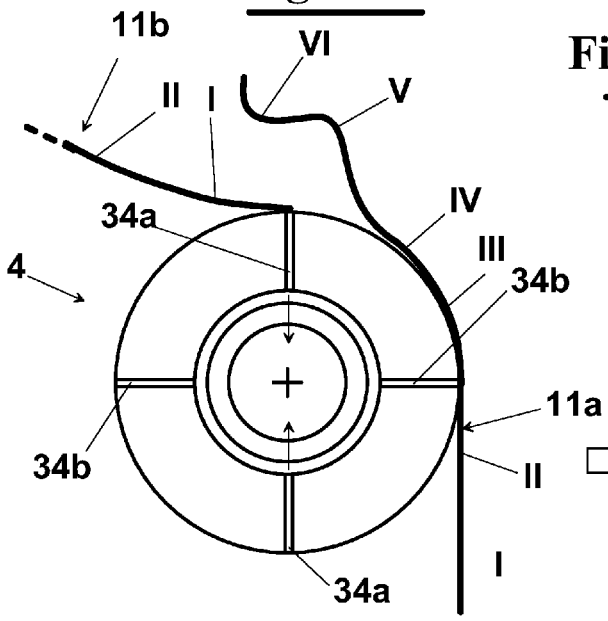
Figure 10B:
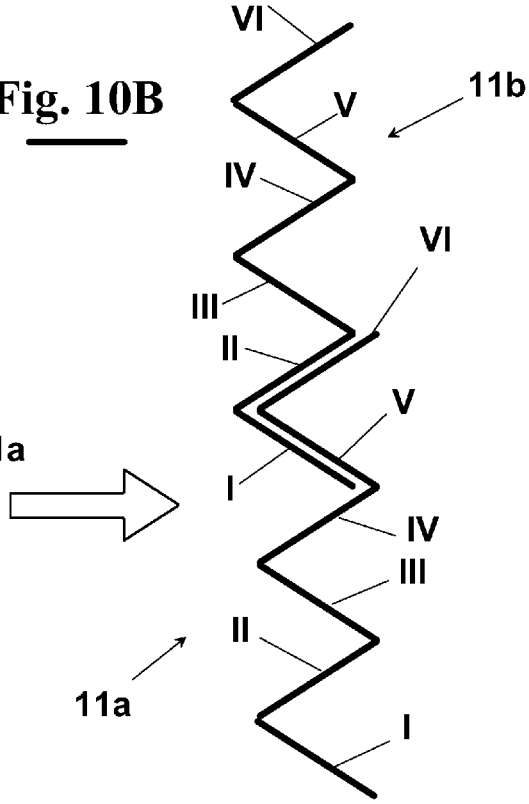

In this case, a sheet 11 obtained by cutting the web of paper 2 has a length 13 equal to half the circumference of cutting roller 2, then equal to two times L1. In particular, in order to enable only holes 34*a* of overlap roller to grip the sheet by suction, whereas holes 34*b* are excluded, means are provided for activating holes 34, not shown in the figure. Each sheet 11 is then folded by interfolding rollers 7 and 8 into six panels I-VI and the resulting interfolded configuration has the last two panels IV-VI of downstream sheet 11*a* overlapped to the first two panels I-III of upstream sheet 11*b* (FIGS. 10A and 10B).

Figure 8A:
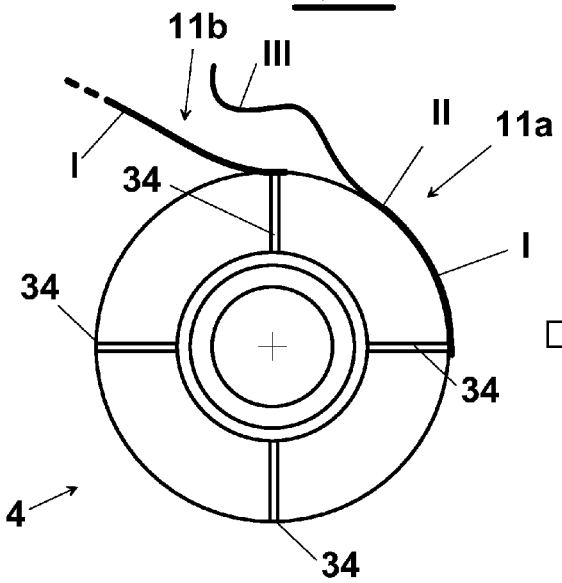
Figure 8B:
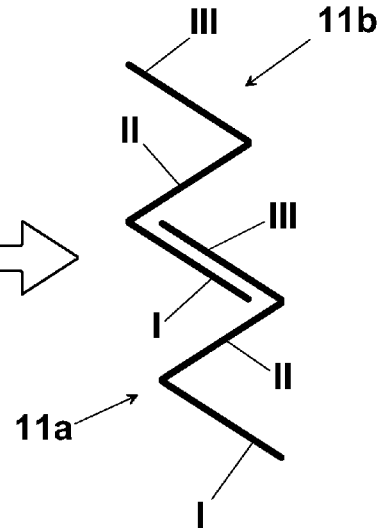
Figure 11A:
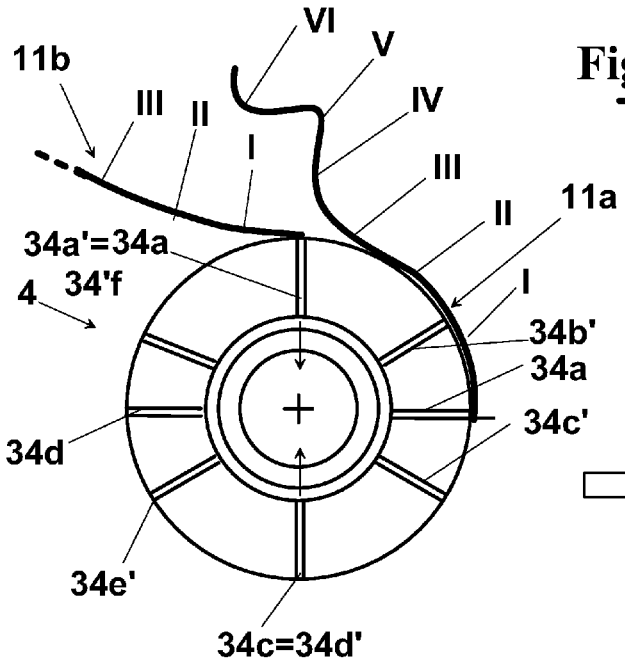
Figure 11B:
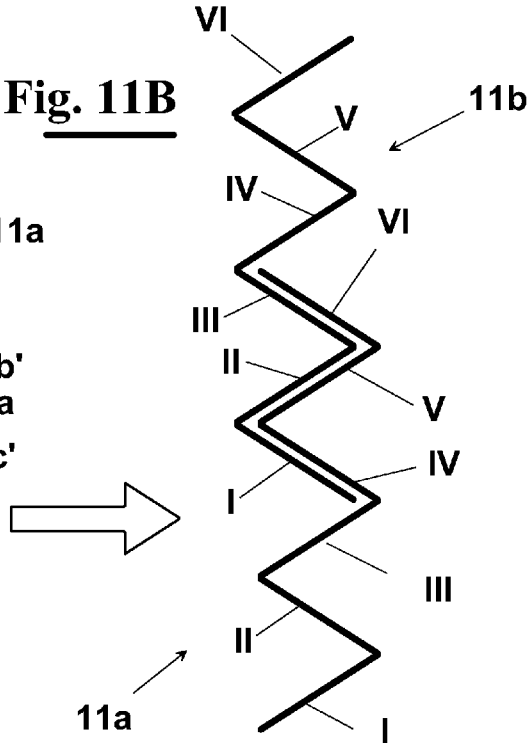

For example, the machine, according to the invention, provides an overlapping configuration where three panels are interfolded by one panel (FIG. 8B), or a configuration wherein four panels are interfolded by two panels (FIG. 9B), or a configuration where six panels are interfolded by two panels (FIG. 10B), or still a configuration wherein six panels are interfolded by three panels (FIG. 11B). In the latter case the sheet overlapping roller has a first series of suction holes 34*a*-34*d* and a second plurality of suction holes 34'*a*-34'*f*. In this case, the machine can provide one or two or three-panel interfolded sheets, since on the sheet overlapping roller six rows of holes rotationally spaced by 60° are provided, with a distance between two rows of consecutive holes equal to two panels, and at the same time four rows of holes rotationally spaced by 90°, with a distance between two rows of consecutive holes equal to three panels.

Normally, with reference to FIGS. 12 and 13, it is possible to provide various combinations of lengths of interfolded sheets with the blades, and/or the sheet head gripping means, which are mounted along the boundary of a single cutting and transferring roller, or of two different rollers, i.e. a cutting roller and a transferring roller, in positions P1-P5 and arranged at a first angular distance $\phi$ and in positions P1'-P3' arranged at an angular distance $\nu$ equal to 120°. The number m and n of the points Pn and Pm' can obviously change.

Always in general, the sheets that have to be folded by the folding rollers according to panels of a same length, would have a length that is multiple to the number of panels. This way, being L1 the first length and N1 the number of panels of the sheets of said first length, and being L2 said second length and N2 the number of panels of the sheets of said second length, and being L the length of the panels, then L1=L*N1, and L2=L*N2. In this case, the circumference of cutting roller 2 is identical or multiple to the minimum common multiple between N1 and N2 multiplied by the respective length L of the panels.

Then, a "multi-fold" machine that has to make selectively three-panel sheets, four-panels sheets and six panel sheets, will have a cutting roller having a diameter at least 12*L, and the blades/suction holes of the head, will have to be selected along the circumference of the roller at positions respectively rotationally distant by a number of panels equal to 3, 4, 6, 8, 9, 12≡0, i.e. with reference to FIG. 12 with P1≡P1'≡0≡12≡0°; P2≡3≡90°, P2'≡4≡120° P3≡6≡180°, P2'≡8≡240°, P4≡9≡270°.

In this case, blades 21 and/or gripping means 27 of a first plurality are mounted along the boundary of a single cutting and transferring roller 2', or of two different rollers, i.e. a cutting roller 2 and a transfer roller 3, in positions P1-P4 arranged at a first angular distance ϕ equal to 90° and blades 21' and/or the gripping means 27' of the second plurality are mounted in positions P1'-P3' arranged at an angular distance ν equal to 120°.

Instead, in a "multi-fold" machine that has to operate selectively sheets three-panel and five-panel sheets, the cutting roller and the transfer roller would have at least a 15*L diameter, and in a way not shown the blades/suction holes of the head, would have to be respectively distant rotationally by a number of panels equal to 0, 3, 5, 9, 10, 12, 15≡0, i.e. with reference to FIG. 13 with P1≡P1'≡0≡15≡0°; P2≡3≡72°, P2'≡5≡120° P3≡6≡144°, P4≡9≡216°, P2'≡10≡240°, P5≡12≡288°.

In this case, blades 21 and/or the gripping means 27 of a first plurality are mounted along the boundary of a single cutting and transferring roller 2', or of two different rollers, i.e. a cutting roller 2 and a transfer roller 3, in positions P1-P5 arranged at a first angular distance ϕ equal to 72° and blades 21' and/or the gripping means 27' of the second plurality are mounted in positions P1'-P3' arranged at an angular distance ν equal to 120°.

Alternatively to what above defined, the transfer roller 5 can also be made so that its circumference is multiple to the length L of a sheet. As shown in FIGS. 14 and 15, in fact, the means for gripping by suction and transferring in the example shown comprises the suction holes, which are arranged at a distance L from one another. More in detail, in case eight suction holes 27*a*-27*h* are present, they are arranged at an angular distance $\phi_1$ equal to 45° (FIG. 14), whereas in case six suction holes 27*a*-27*f* are present, they are arranged at an angular distance $\phi_2$ equal to 60° (FIG. 15)

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. An interfolding machine to obtain an interfolded product starting from a web of paper, comprising:

a cutting roller arranged to cut a web of paper that is fed to said machine into sheets of determined length;

a transfer roller to transfer the sheets of predetermined length along a conveying path;

a device to actuate said cutting roller and said transfer roller so that said web of paper and said sheets proceed at a first speed V1;

an overlap roller adapted to pick up said sheets from said conveying path and to overlap them in turn by a predetermined sheet portion;

a device to actuate said overlap roller to convey said sheets at a second speed V2 less than V1, a speed difference between the first speed V1 and the second speed V2 being imposed for partially overlapping two consecutive sheets according to said sheet portion;

a plurality of folding rollers for folding consecutive overlapped sheets into panels in order to provide a stack of interfolded sheets;

wherein:

said cutting roller comprises first and second cutting blades for cutting, respectively, sheets of a first and of a second length;

said transfer roller transfers sheets of said first and of said second length;

said overlap roller overlaps sheets of said first and said second length;

wherein a device is also provided for selecting alternatively:

in case of sheets of said first length, said first cutting blade;

in case of sheets of said second length, said second cutting blade.

2. An interfolding machine according to claim 1, wherein said cutting roller is arranged to cut the web of paper in combination with a counter-support means, which acts opposite to said web of paper with respect to said cutting roller to provide said cutting of said web of paper into said sheets of said first or said second length.

3. An interfolding machine according to claim 1, wherein said cutting roller comprises a first plurality of blades arranged peripherally on said cutting and transferring roller at a first angular distance; and a second plurality of blades arranged peripherally on said cutting roller at a second angular distance, wherein said first and said second plurality of blades are selectively operated for cutting said web into sheets of said first length and of said second length, respectively.

4. An interfolding machine according to claim 1, wherein said transfer roller comprises a means for gripping each sheet at least at a respective sheet trailing edge that has been formed after cutting.

5. An interfolding machine according to claim 1, wherein said transfer roller comprises a plurality of suction holes for gripping each sheet at least at a portion comprising a respective sheet tail edge formed after cutting, such that a successive sheet that moves along said conveying path overlaps by said measured portion under a previous sheet whose trailing edge has been already gripped by said overlap roller.

6. An interfolding machine according to claim 5, wherein said plurality of suction holes for gripping and said overlap roller act only in a determined arch of the transfer roller.

7. An interfolding machine according to claim 1, wherein said cutting roller comprises a first plurality of blades arranged peripherally on said cutting roller at a first angular distance, and a second plurality of blades arranged peripherally on said cutting roller at a second angular distance, said first and said second plurality of blades being selectively operated for cutting said web into sheets of said first and of said second length, respectively; and wherein said cutting roller comprises, at each of said blades, a plurality of suction holes for gripping and adapted to keep each sheet at least at a respective sheet trailing edge that has been formed after cutting.

8. An interfolding machine according to claim 7, wherein said first plurality of blades and said second plurality of blades are mounted at respective housings in a way movable selectively between a cutting position, in which said blades protrude from said cutting roller, and a rest position, in which said blades are withdrawn with respect to said cutting roller.

9. An interfolding machine according to claim 8, wherein a device is provided for actuating said blades between said cutting position and said rest position.

10. An interfolding machine according to claim 9, wherein said device for actuating said blades between said cutting position and said rest position is an actuator having a stem with an end connected to the blade and the other end that is movable in an actuating chamber, said blade being pivotally constrained to said roller at a pivot point, said end of said actuator sliding in said actuating chamber for causing the rotation of said blade about said pivot point to obtain a movement of said blade from said cutting position to said rest position, or vice-versa.

11. An interfolding machine according to claim 9, wherein said device for actuating said blades between said cutting position and said rest position is a carriage integral to each blade sliding on a guide, said carriage withdrawing/protruding with respect to the boundary of said roller along said guide for bringing said blade from said cutting position to said rest position, or vice-versa.

12. An interfolding machine according to claim 9, wherein said device for actuating said blades between said cutting position and said rest position comprises a first plurality of blade holders arranged peripherally on said roller at said first angular distance and a second plurality of blade holders arranged peripherally on said roller at said second angular distance, such that said blades can be mounted on said roller at said first or at said second plurality of blade holders to make said sheets of said first, or of said second length, respectively.

13. An interfolding machine according to claim 1, wherein said transfer roller comprises a first plurality of suction holes for gripping the sheet trailing edges, which is arranged peripherally at a first angular distance and that is adapted to transfer to said overlap roller said sheets of said first length, and a second plurality of suction holes for gripping the sheet trailing edges, which is arranged peripherally at a second angular distance and that is adapted to transfer to said overlap roller said sheets of said second length.

14. An interfolding machine according to claim 1, wherein said transfer roller comprises a plurality of suction holes for gripping a sheet trailing edge arranged peripherally at an angular distance that defines an arch equal to the length of a sheet and that is adapted to transfer to said overlap roller said sheets of said first and second length of said transfer roller.

15. An interfolding machine according to claim 1, wherein a plurality of folding rollers is provided that is arranged to fold said sheets according to panels of a same length, so that each sheet has a length that is multiple to the number of panels, being L1 said first length and N1 the number of panels of the sheets of said first length, and being L2 said second length and N2 the number of panels of the sheets of said second length, and being L the length of the panels, so that L1=L*N1, and L2=L*N2, wherein the circumference of the cutting roller and of the transfer roller is identical or multiple to the minimum common multiple between N1 and N2 multiplied by the respective length of the panels, and the first and second cutting blades, said transfer roller, and said overlap roller is arranged along the circumference in positions multiple both to N1 and to N2.

16. An interfolding machine according to claim 1, wherein said overlap roller comprises holes adapted to grip the head of each sheet, wherein the distance in a circumferential direction between the holes is selected from the group consisting of one, two, three, or four panels.

17. An interfolding machine according to claim 1, wherein a means is provided for adjusting said actuating device, said cutting roller, said transferring roller, and said overlapping roller, wherein the means for adjusting is adapted to change speed V1.

18. An interfolding machine according to claim 1, wherein a means is provided to change the speed V2.

19. An interfolding machine according to claim 1, wherein a means is provided to change the ratio between speed V1 and V2.

20. An interfolding machine according to claim 1, wherein a means is provided to change a phase shift between the cutting roller, the transfer roller, and the overlap roller.

* * * * *